US006568232B1

(12) United States Patent
Olsson et al.

(10) Patent No.: US 6,568,232 B1
(45) Date of Patent: May 27, 2003

(54) METHOD AND A DEVICE FOR CONTROLLING THE DIMENSIONS OF AN ELONGATED MATERIAL ROLLED IN A ROLLING MILL

(75) Inventors: Mats Olsson, Västerås (SE); Dag Sollander, Västerås (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/743,451

(22) PCT Filed: Jul. 9, 1999

(86) PCT No.: PCT/SE99/01250

§ 371 (c)(1),
(2), (4) Date: Mar. 14, 2001

(87) PCT Pub. No.: WO00/02679

PCT Pub. Date: Jan. 20, 2000

(30) Foreign Application Priority Data

Jul. 10, 1998 (SE) ..... 9802494

(51) Int. Cl.[7] ..... B21B 37/68

(52) U.S. Cl. ..... 72/8.9; 72/11.6; 72/205; 72/365.2

(58) Field of Search ..... 72/8.8, 8.9, 9.2, 72/9.3, 11.5, 11.6, 11.8, 11.9, 12.5, 12.7, 205, 365.2

(56) References Cited

U.S. PATENT DOCUMENTS

| | | | | |
|---|---|---|---|---|
| 4,089,196 A | | 5/1978 | Kondo et al. | |
| 4,537,051 A | * | 8/1985 | Niino et al. | 72/11.6 |
| 4,665,730 A | * | 5/1987 | Maroti | 72/8.8 |
| 6,167,736 B1 | * | 1/2001 | Shore | 72/8.8 |

FOREIGN PATENT DOCUMENTS

| | | | | |
|---|---|---|---|---|
| JP | 56-6701 | * | 1/1981 | 72/235 |
| JP | 62-38711 | * | 2/1987 | 72/11.6 |
| JP | 8-30027 | | 11/1996 | |

* cited by examiner

*Primary Examiner*—Ed Tolan
(74) *Attorney, Agent, or Firm*—Connolly Bove Lodge & Hutz LLP

(57) ABSTRACT

A method and apparatus for controlling the dimensions of an elongated material rolled in a rolling mill comprising at least two mill stands arranged after each other, each of said stands comprising two spaced rolls, said elongated material being fed between the rolls of each stand by rotating the rolls, wherein the material is subjected to stresses in the longitudinal direction thereof during the rolling operation. A rear portion of said material is subjected to an additional tension substantially in the longitudinal direction of the material when a rear end of the material is in the vicinity of a first stand and has not yet passed said stand.

16 Claims, 1 Drawing Sheet

METHOD AND A DEVICE FOR CONTROLLING THE DIMENSIONS OF AN ELONGATED MATERIAL ROLLED IN A ROLLING MILL

This application is a 35 USC 371 of PCT/SE99/01250 filed Jul. 7,1999.

FIELD OF THE INVENTION

The present invention is related to a method for controlling the dimensions of an elongated material rolled in a rolling mill comprising at least two mill stands arranged after each other, each of said stands comprising two spaced rolls, said elongated material being fed between the rolls of each stand by rotating the rolls, wherein the material is subjected to stresses in the longitudinal direction thereof during the rolling operation. More particularly, it relates to a rolling mill for the production of materials with shapes different from sheets or strips, such as rods and bars of various types.

The present invention is further related to a device for controlling the dimensions of an elongated material rolled in a rolling mill.

PRIOR ART

A rolling mill normally comprises a plurality of mill stands arranged after each other. Each of said stands comprises two spaced rolls with parallel rotation axes. A material is fed between the rolls of each stand, and thereby rolled, by rotating the rolls. The rolled material will elongate and spread as the cross-section of the rolled material is reduced as it passes through said stands. The cross section after each stand is defined by the passdesign and the layout of the mill. The cross section is defined by the height and the width of the material leaving a roll gap.

Typically, the rolls of a first stand rolls the material in a first direction, and the rolls of a second, adjacent stand rolls the material in a direction perpendicular to the first direction. Usually, the rolls of said first stand have horizontally directed rotation axes and the rolls of said second stand have vertically directed rotation axes. Thus, a vertical dimension of the rolled material is reduced in said first stand and the horizontal dimension of the rolled material is reduced in said second stand.

As the material passes between the mill stands, there exists a tension, i.e. a tensile or compressive stress, in the longitudinal direction of the material between any two mill stands. A tension in the rolled material between any two stands is described hereafter as an interstand tension. The interstand tension is changed by adjusting the rotational speed of the rolls of a first mill stand relative to the rotational speed of the rolls of a second mill stand.

In the practise of semi-continuous hot rolling, billets are rolled one at a time. The first part of the billet entering the rolling mill is known as the head end. The final part of the rolled material is known as the tail end. When the tail end of the billet leaves one of said stands, the degree of control over the dimensions of the rear portion of the rolled material is reduced. The interstand tension in the rear portion of the rolled material changes as the tail end of the billet leaves the stand. Most frequently, the interstand tension is reduced for the tail. A compressive stress is normally generated in the rear portion, which causes an increase in width at the end of the tail. The rear portion is normally defined as substantially the part of the material extending between two successive stands. The part of the material, in which said increase in width is imposed, is normally useless and wasted after the rolling operation. However, a quantity of rolled material in the rear portion of the rolled material represents a considerable part of the rolled material. Thus, an additional control method is desired for controlling the dimensions of the rear portion of the rolled material in order to reduce the amount of sub-standard material produced in each rolled material.

SUMMARY OF THE INVENTION

The object of the invention is to reduce the amount of sub-standard material of a rolled material. A further object of the invention is to design ways to control the dimensions of a rear portion of the material.

These objects are achieved in that a rear portion of said material is subjected to an additional tension substantially in the longitudinal direction of the material when a rear end of the material is in the vicinity of a first stand and has not yet passed said stand. In this way, said additional tension compensates for the generated increase in width in the rear portion of said material when the rear end of the material has passed the first stand. A further advantage is that the control method may be fitted easily and at low capital cost to an existing rolling mill, as the method only requires additional measurement and control equipment. By controlling the dimensions of the rear portion of the rolled material, wear and miss-alignment of the rolls and guide rails are reduced.

According to a preferred embodiment of the invention, the rear portion of said material comprising the rear end of said material is subjected to said additional tension. In this way, the amount of sub-standard material of the rolled material is minimised. Preferably, the rear portion of said material is subjected to said additional tension as said rear end of the material is in contact with the rolls of said first stand.

According to another preferred embodiment of the invention, said material is in contact with the rolls of a second stand during said tension application. Thus, the additional tension may be applied by controlling the rolls of said first and second stand. Preferably, the rear portion of said material is subjected to said additional tension by decreasing the rotational speed of the rolls of said first stand relative to the rotational speed of the rolls of said second stand.

The rear portion of said material is preferably subjected to said additional tension with a first magnitude based partly on width measurements made on at least one elongated material previously fed passed said first stand and partly on width measurements on itself. Thus, the width measurements, and the magnitude of the additional tension used on said previously fed elongated material are used and the first magnitude of the additional tension is calculated based on these parameters. Preferably, said width measurements and the magnitude of the tension are stored for a plurality of previously fed materials, and used for the calculation of the first magnitude of the tension of the actual, subsequent rolled material.

The present method is applicable to any part of the rolling mill for controlling the width of the rear portion of a rolled material.

The inventive device for controlling a rolling mill is more closely defined in the claims and the following description.

BRIEF DESCRIPTION OF THE DRAWINGS

With reference to the enclosed drawings a more close description of embodiment examples of the invention follows hereunder.

In the drawings.

DESCRIPTION OF PREFERRED EMBODIMENTS

Figure 1:
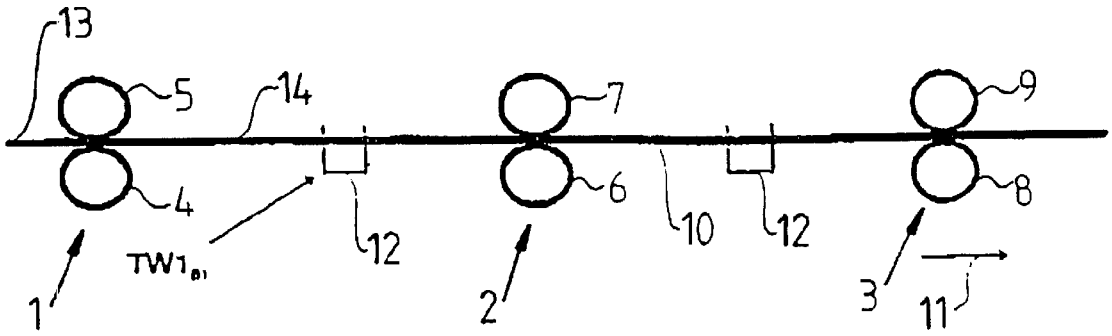
FIG. 1 shows schematically a rear end of a rolled material before passing through a first mill stand according to the invention.

FIG. 1 illustrates a part of a rolling mill comprising three successive mill stands 1, 2, 3. Each of the stands comprises two rolls 4, 5, 6, 7 and 8, 9 respectively. The rolls of each stand are arranged with parallel rotation axes. An elongated material 10 is fed between the rolls of each stand from left to right in the figure, see arrow 11. Said part of the rolling mill comprising said stands 1, 2, 3 could be comprised in any section of the rolling mill.

Presence of a rear end 13 of the material 10 upstream of said first stand 1 is detected. This detection may be realised in a plurality of ways, such as by means of optical or electromagnetical arrangements. After said detection of said rear end 13 of the material 10, a rear portion 14 of the material is subjected to an additional tension substantially in the longitudinal direction of the material. Normally, the tension is a tensile stress. It will here after be referred to as a tensile stress. This is performed by decreasing the rotational speed of the rolls 4, 5 of said stand 1 relative to the rotational speed of the rolls 6, 7 of said stand 2. In his way, the rear portion 14 of the material 10 defined as the part of the material 10 located between said stands 1, 2 is subjected to said additional tensile stress. Thus, it is compensated for an undesired increase in the width of the material taking place when the rear end 13 of the material 10 passes said stand 1.

The decreased relative rotational speed of the rolls of said stand 1 and said stand 2 is preferably applied for a duration enough for that the complete rear portion 14 of the material 10, and preferably comprising the rear end 13, is effected by the additional tensile stress before the rear end 13 of the material passes said first stand 1.

The first measuring means 12 is arranged to measure the width of the material 10. The inventive method comprises the steps of measuring the width of the rear portion 14 of the material 10 by means of the measuring means 12 before the rear end 13 has passed said first stand 1. Thereafter, the rear portion 14 of said material 10 is subjected to said additional tensile stress of a second magnitude while said rear end 13 of the material 10 still has not passed said stand 1. Thereafter, the width of the rear portion 14 of the material 10 is measured by means of the measuring means 12 in a second operation. The width of a subsequent material is measured before the rear end of the material has passed said first stand. A first magnitude of the additional tensile stress to be applied on the subsequent material is calculated based on the width measurements and said second magnitude of the additional tensile stress. Thereby, differences in dimensions between materials are taken care of.

Figure 2:
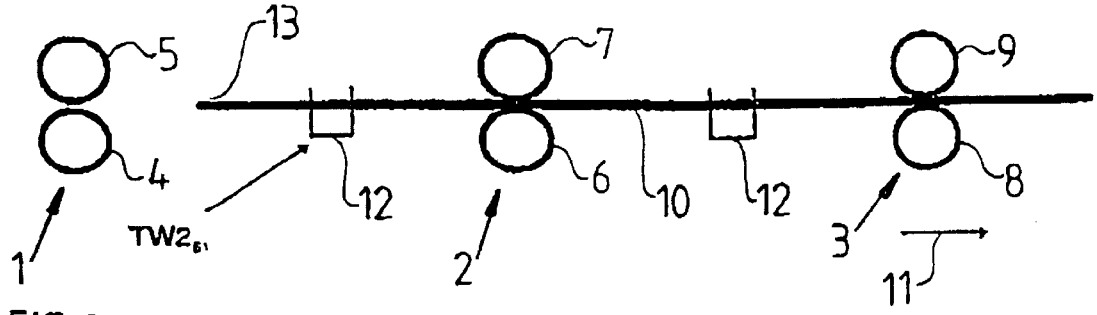
FIG. 2 shows schematically the rear end of the rolled material after it has left a first mill stand according to the invention.

FIG. 1 illustrates the position of the material 10 when the measuring means 12 measures the width $TW1_{s1}$ in the first operation. FIG. 2 illustrates the position of the material 10 when the measuring means 12 measures the width $TW2_{s1}$ in the second operation. Thus, the measurements in said first and second operation are made onto spaced parts of the material 10.

Figure 3:
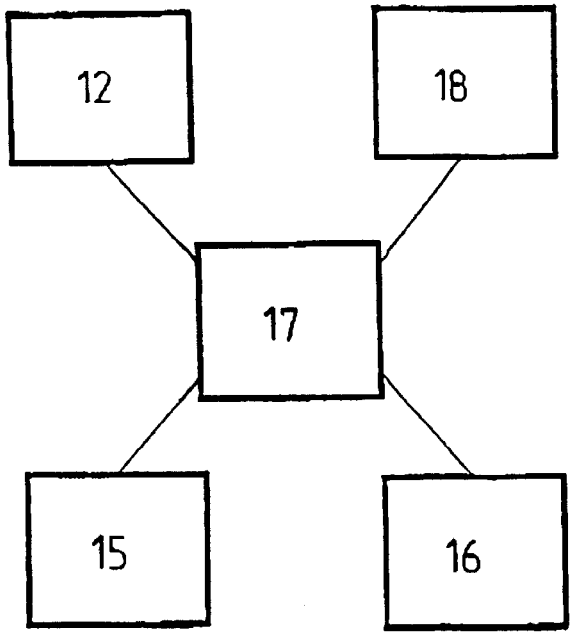
FIG. 3 is a block diagram of the device for controlling the dimensions of an elongated material rolled in a rolling mill.

FIG. 3 illustrates schematically an embodiment example of a control device for controlling the dimensions of an elongated material rolled in a rolling mill. The control device comprises means 15, 16 for rotating the rolls of said first stand 1 and said second stand 2, respectively. The rotation means are preferably formed by electric motors. The control device further comprises control means 17 connected to the rotation means 15, 16 and arranged for controlling the rotation means 15, 16. The control device also comprises means 18 for detecting presence of the rear end 13 of the material 10 upstream and downstream of said first stand 1. The function of the detecting means 18 is discussed above. Said control means 17 comprises memory means for storing width measurement values and measures of said additional tensile stress. Said control means further comprises means for calculating the magnitude of said additional stress for a subsequent material based on width measurements of at least one previously fed material and the magnitude of the additional tensile stress applied to that material.

A further measuring means 12 is located between the second 2 and third stand 3, having the same function as the measuring means 12 located between the first 1 and second stand 2.

An example of how the inventive control method is realised follows hereunder.

The speed of each mill stand is independently controlled via a cascade system comprised in said control means.

The additional tensile stress is hereunder referred to as a tailout prestress adjustment, TOA. It is measured and calculated in the following way.

Referring to FIG. 1. The rolled material moves downstream from left to right in the direction of the arrow marked 11. A tailout adjustment for a mill stand X. $TOA_x$ is achieved by changing the tension between two mill stands by controlling the speeds of the mill stands. The tailout width TW of a rolled material is measured at the measuring means 12, preferably formed by a sensor before leaving a stand as $TW1_{sx}$ and after leaving the mill stand as $TW2_{sx}$. The measured values are stored in said memory means and used for calculations of tailout width adaption.

A pre-stress tailout adjustment for a mill stand X, $TOA_x$ is calculated for every billet of rolled material using:

$$TOA_x = \text{Adaption} * TW1_{sx} \text{ where}$$

Adaption is the difference between the predicted tailout width and the actual tailout width measured after stand X on previous billets $TW1_{sx}$ is the tailout width before stand X for the present billet.

The value for the Adaption is the difference between the tailout width expected after stand X following an adjustment, and the width as measured. By adapting the adjustment according to the difference in predicted and actual result for a given mill stand, the adjustment produces the expected result almost exactly on succeeding billets of rolled material.

For the first billet of rolled material, or the first billet following a roll gap change at a mill stand, a prestress tailout adjustment is calculated using $$TOA_x = K * TW1_{sx} \text{ where}$$

K is the area reduction ratio for stand X from schedule, or a substitute value $TW1_{sx}$ is the tailout width before stand X for the present billet.

The value K used for the first billet of rolled material corresponds substantially to the Adaption value used on every billet except the,first. A calculated value is used because there is no previous billet to base an actual Adaption on.

In a further development of the method described the value of the Adaption is averaged from a number of billets, a suitable number being greater than 2 and less than 20, for example 5 billets.

Measurements of the height and width of the rolled material between a pair of mill stands to measure the tailout width are preferably carried out using U-gauges manufactured by ABB Industrial Products AB. The U-gauges provide measurements of the diameters of a bar by an electro-inductive method of direct measurement. Within the scope of the invention it is also possible to use alternative measuring devices to measure the diameters of the rolled material for example optical equipment such as lasers or cameras, x-ray equipment, or combinations of optical methods and mechanical sensors.

It should be noted that the description presented here above only should be considered as exemplifying for the inventive idea, on which the invention is built. Thus, it is obvious for a man skilled in the art that detailed modifications may be made without leaving the scope of the invention.

What is claimed is:

1. A method for controlling the dimensions of an elongated material (10) rolled in a rolling mill comprising at least two mill stands (1, 2) arranged after each other, each of said stands comprising two spaced rolls (4, 5, 6, 7), said elongated material being fed between the rolls of each stand by rotating the rolls, wherein the material is subjected to stresses in the longitudinal direction thereof during the rolling operation, comprising:

measuring in a first operation the width of a rear portion of a previously fed elongated material through said mill stands at a location downstream of a first stand while said rear portion is subjected to a first tension of a first magnitude; and subjecting a rear portion (14) of said material (10) to an additional tension with a second magnitude, based on said first tension of a first magnitude and said resulting measured width of said previously fed elongated material, substantially in the longitudinal direction of the material when a rear end (13) of the material is in the vicinity of said first stand (1) and has not passed said stand (1).

2. A method according to claim 1, wherein said additional tension is a tensile stress.

3. A method according to claim 1, wherein the rear portion (14) and the rear end (13) are subjected to said additional tension.

4. A method according to claim 1, wherein the rear portion (14) of said material (10) is subjected to said additional tension when said rear end (13) of the material(10) is in contact with the rolls (4, 5) of said first stand (1).

5. A method according to claim 1, wherein said material (10) is in contact with the rolls (6, 7) of a second stand (2) during said additional tension application.

6. A method according to claim 5, wherein the rear portion (14) of said material (10) is subjected to said additional tension by decreasing the rotational speed of the rolls (4, 5) of said first stand (1) relative to the rotational speed of the rolls (6, 7) of said second stand (2).

7. A method according to claim 6, wherein the rear portion (14) of said material (10) is subjected to said additional tension by decreasing the rotational speed of the rolls (4, 5) of said first stand (1).

8. A method according to claim 1, wherein the first operation, the width of said previously fed material is measured between said first (1) and second stand (2).

9. A method according to claim 1, wherein the rear portion (14) of the material (10) upstream of said first stand (1) is detected, and initiating the first measuring operation initiated after said presence detection.

10. A method according to claim 2, wherein the rear portion (14) comprising the rear end (13) is subjected to said additional tension.

11. A method according to claim 2, wherein the rear portion (14) of said material (10) is subjected to said additional tension as said rear end (13) of the material (10) is in contact with the rolls (4, 5) of said first stand (1).

12. A method according to claim 3, wherein the rear portion (14) of said material (10) is subjected to said additional tension as said rear end (13) of the material (10) is in contact with the rolls (4, 5) of said first stand (1).

13. A device for controlling the dimensions of an elongated material rolled in a rolling mill comprising: at least two mill stands (1, 2) arranged after each other, each of said stands comprising two spaced rolls (4, 5, 6, 7) and means (15, 16) for rotating the rolls in order to feed the material between the rolls of each stand, comprising:

means (18) between said first stand (1) and second stand (2) for detecting a presence of a rear end of the material upstream of said first stand;

means (12) for measuring the width of the material (10) between said first (1) stand and second stand (2);

means for calculating a first magnitude of tension for applying to a subsequently fed material based on at least two measurements of the width of a previously fed material and on a second magnitude of a tension applied to said previously fed material; and means (17) for controlling operation of the rolls of at least said first stand (1) so that a rear portion (14) of the material (10) is subjected to said first magnitude of tension substantially in the longitudinal direction.

14. A device according to claim 13, wherein the control means (17) is arranged for controlling the rotation means (15, 16) in order to regulate the rotational speed of the rolls (4, 5) of said first stand (1) in relation to the rotational speed of rolls (6, 7) of said second stand (2).

15. A method for controlling first and second mill stands through which an elongated material passes comprising:

applying a first magnitude of tension to said elongated material in the longitudinal direction when a rear end of said elongated material is in the vicinity of said first stand and has not yet passed through said first stand;

determining a resulting width formed on an end portion of an elongated material as it passes through said first mill under said first magnitude of tension; and controlling the rotation of rolls of each stand through which a subsequent elongated material passes to produce a magnitude of tension on said subsequent elongated material which is based on said resulting width from said first magnitude of tension.

16. A device for controlling first and second mill stands through which an elongated material passes comprising:

means for controlling the rotation of rollers in said first and second mill stands to feed said elongated material between stands;

means for measuring a width of the material between the first and second stands; and means for calculating a first magnitude of additional tension to be applied to said elongated material based on first and second measurements of width of said material, and on a previously applied magnitude of additional tension applied to said material; and means for controlling the rotation of rollers to apply said additional tension to a subsequent length of elongated material so that a rear portion of the material is subjected to an additional tension substantially in the longitudinal direction of the material when the rear end of said elongated material is in the vicinity of said first stand and has not yet passed through said first stand.

* * * * *